United States Patent [19]

Armstrong et al.

[11] 4,308,135

[45] Dec. 29, 1981

[54] SIZING SCREENS

[75] Inventors: Michael P. Armstrong, Etwall; Rodney W. O'Brian, Burton-on-Trent; Stanley Gilliver, Midway, all of England

[73] Assignee: Coal Industry (Patents) Limited, London, England

[21] Appl. No.: 76,665

[22] Filed: Sep. 18, 1979

[30] Foreign Application Priority Data

Sep. 29, 1978 [GB] United Kingdom ..... 38628/78

[51] Int. Cl.[3] ..... B07B 1/08

[52] U.S. Cl. ..... 209/240; 209/254; 209/255; 209/350

[58] Field of Search ..... 209/350, 351, 279, 255, 209/257, 259, 271, 240, 453, 444, 495, 309, 280, 389, 235–237, 933, 254, 243

[56] References Cited

U.S. PATENT DOCUMENTS

| | | | |
|---|---|---|---|
| 236,844 | 1/1881 | Russell | 209/351 X |
| 886,966 | 5/1908 | Findley | 209/257 X |
| 931,280 | 8/1909 | Cunningham | 209/350 |
| 1,961,478 | 6/1934 | De Baulk | 209/933 X |
| 2,029,090 | 11/1936 | Yewell | 209/444 |
| 2,787,375 | 4/1957 | Couplet | 209/350 |
| 2,915,181 | 12/1959 | Topp | 209/279 |
| 4,220,526 | 9/1980 | Armstrong et al. | 209/240 |

FOREIGN PATENT DOCUMENTS

| | | | |
|---|---|---|---|
| 567832 | 8/1930 | Fed. Rep. of Germany | 209/350 |
| 1019998 | 11/1957 | Fed. Rep. of Germany | 209/350 |
| 2843286 | 4/1979 | Fed. Rep. of Germany | 209/350 |

*Primary Examiner*—Robert Halper

*Attorney, Agent, or Firm*—Stevens, Davis, Miller & Mosher

[57] ABSTRACT

A sizing screen for particulate material of different sizes has a generally horizontal rotatable circular screen surface having a plurality of elongate radially projecting members, first collection means positioned adjacent the outer periphery of the surface for collecting an oversize fraction of the particulate material, second collection means positioned below the surface for collecting an undersize fraction of the material which passes through the screen. Discharge means comprising a rotatable table partitioned into different parts for carrying the oversize and undersize material is positioned below the first and second collection means. A plough or paddle preferably urges material from the table into outlets. The screen is suitable for handling sticky material such as coal fines and clay.

4 Claims, 8 Drawing Figures

SIZING SCREENS

This invention concerns sizing screens for particulate material of different sizes and discharge means therefor.

In particular, though not exclusively, the invention relates to sizing screens for screening moist, small size particles, e.g. less than twenty-five millimeters. The invention is particularly, though not exclusively useful, in treating sticky material such as moist raw coal containing clay.

In dealing with the discharge of such material it can happen that the sized material clogs up either or both of the undersize and oversize discharge means through which it passes through. To mitigate this problem, discharge means have tended to be generally vertical or steeply inclined in order that gravity should aid the flow of sized material. Moreover, it has been found necessary to have more than one outlet for either or both of the undersize and oversize discharge means in order that the entire mass of screened material can be effectively discharged.

An object of the present invention is to provide a sizing screen for particulate material of different sizes and a discharge means therefore which tends to overcome the above-mentioned clogging difficulties.

According to one aspect of the present invention, a sizing screen for particulate material of different sizes comprises a feeder means for feeding material into the screen, a rotatable circular screen surface to receive material from the feeder means and having a plurality of elongate radially projecting members, first collection means positioned adjacent to the outer periphery of the surface for collecting an oversize fraction of the particulate material, second collection means positioned below the surface for collecting an undersize fraction of the particulate material and discharge means positioned below the first and second collection means, the discharge means including a rotatable table partioned into different parts for carrying the oversize and undersize material respectively.

Preferably, the parts for carrying oversize and undersize material are provided with a respective outlet means and a respective urging means for urging material into the respective outlet means.

According to another aspect of the present invention, a discharge device for sizing screen for particulate material of different sizes comprises a rotatable table positioned towards the bottom of the sizing screen, said rotatable table being partitioned into separate parts for receiving an oversize and undersize fraction of material thereupon, respectively, each part having associated therewith a respective outlet means.

The urging means is conveniently a fixed plough, although it is envisaged that if the material to be handled is extremely sticky and builds up to an unacceptable amount on a plough, a more positive displacement device may be used. A more positive displacement device would be a rotating paddle arrangement rotating contrary to the table, thus collecting material from the table and urging it to the outlet means. It may be advantageous to use a fixed plough to discharge the oversize material, and a paddle arrangement to discharge the undersize material. The paddle may co-operate with a fixed plough shaped to the arc of rotation of the paddle blades. The invention will, however, be hereinafter be more particularly described with reference to a fixed plough, without being limited thereto.

Preferably, a plough is mounted adjacent to each part of the table for urging material from that part into the respective outlet means.

Conveniently, a partition means is provided for partitioning the rotatable table. The partition means preferably comprises a ring shaped member attached to the rotatable table.

Advantageously, a motor rotates the table to urge the oversize and undersize material into the respective plough.

An embodiment of the present invention will now be described by way of example only with reference to the accompanying drawings in which.

Figure 1:
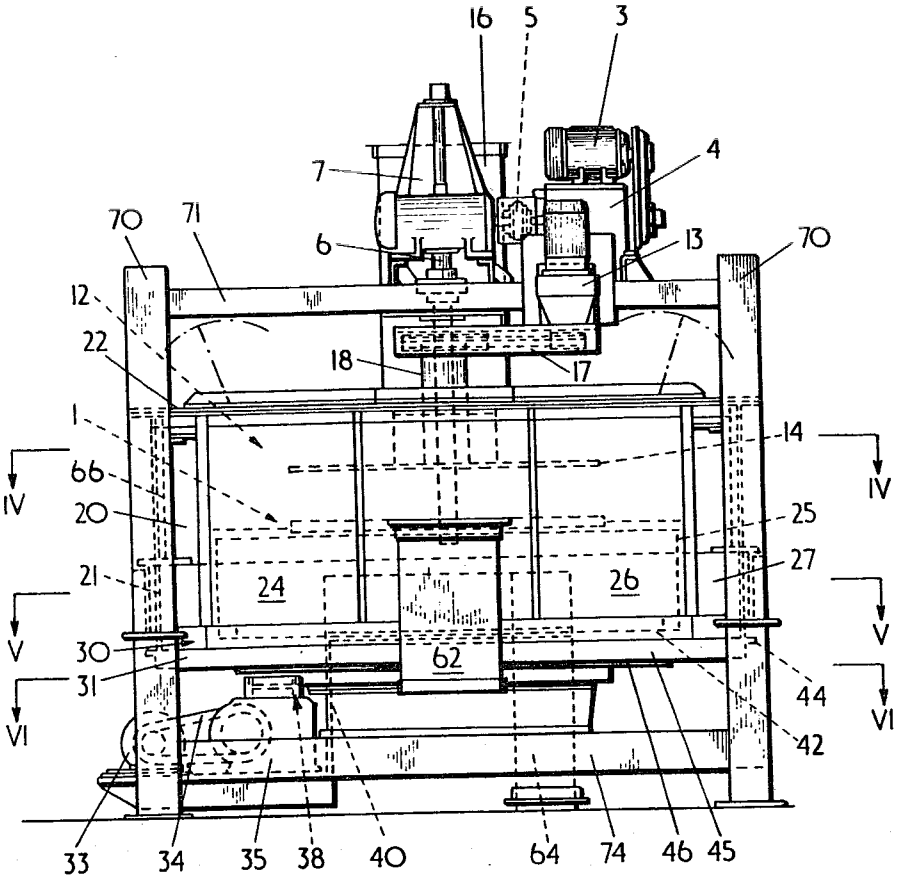
FIG. 1 is a side view of a sizing screen.
Figure 2:
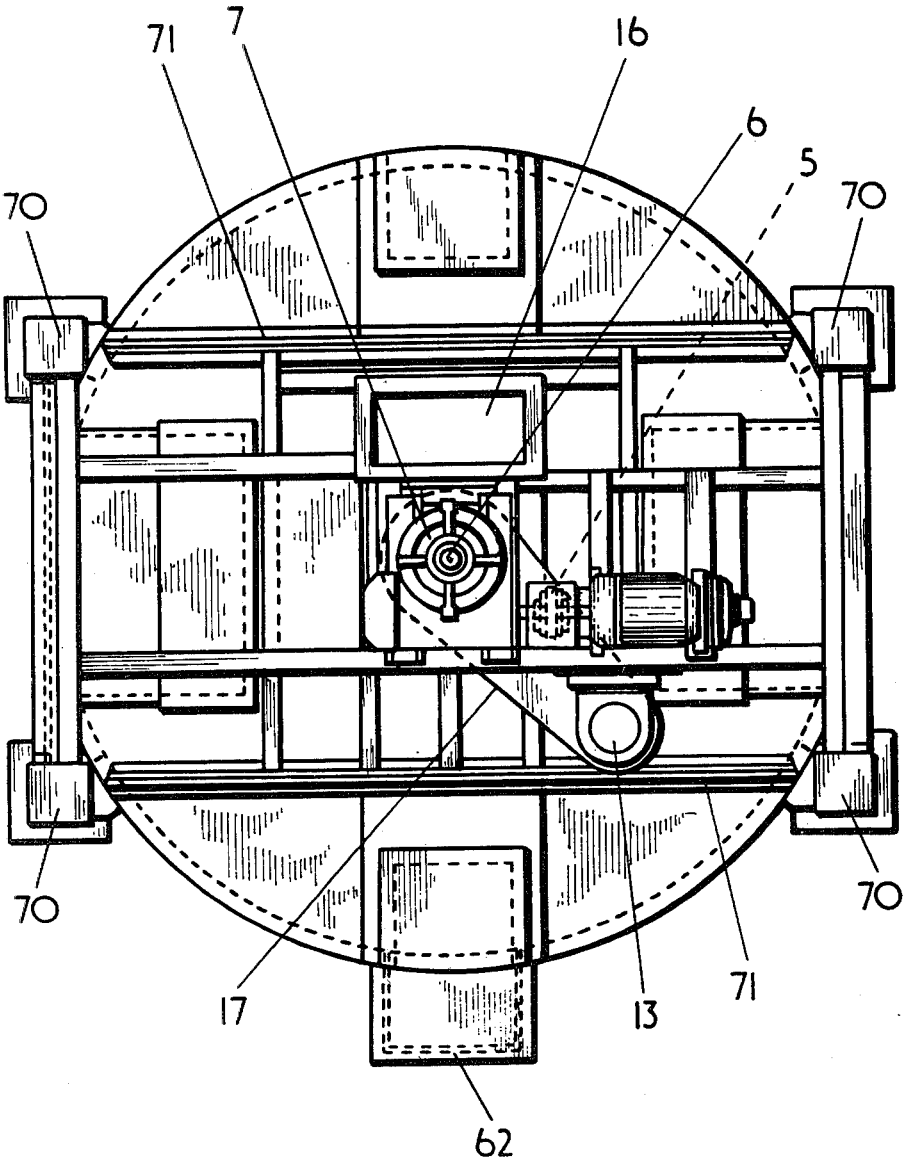
FIG. 2 is a plan of FIG. 1.
Figure 3:
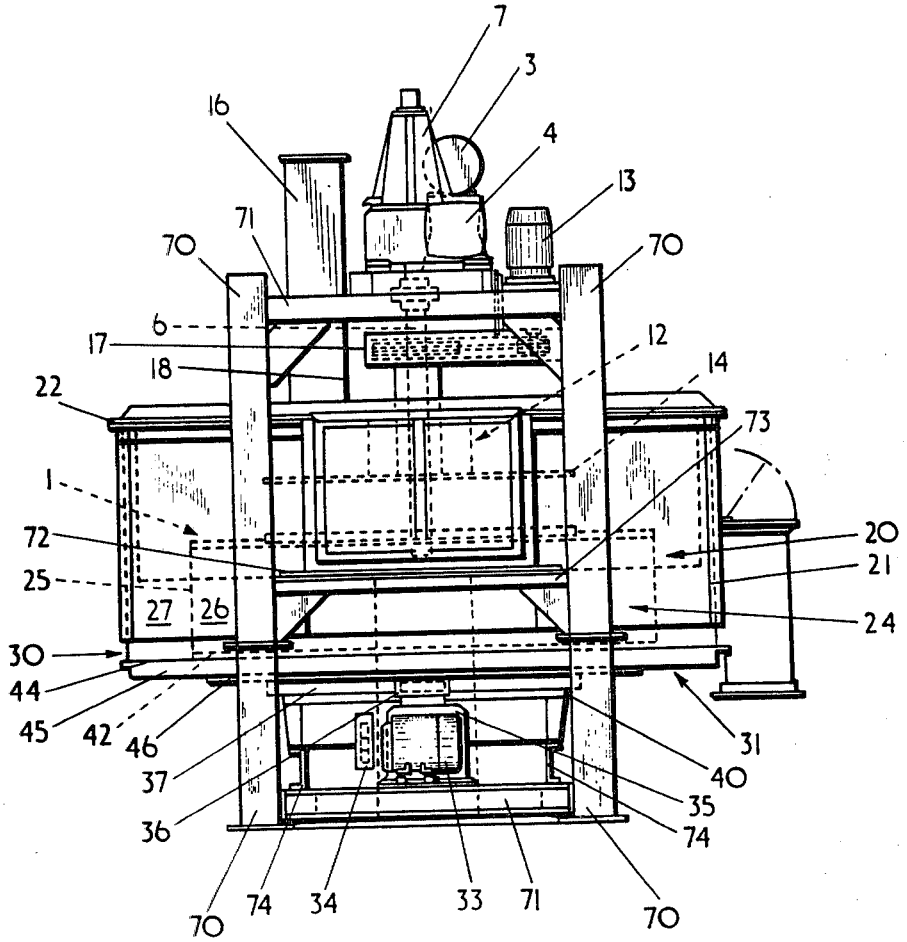
FIG. 3 is one end view of the sizing screen.
Figure 4:
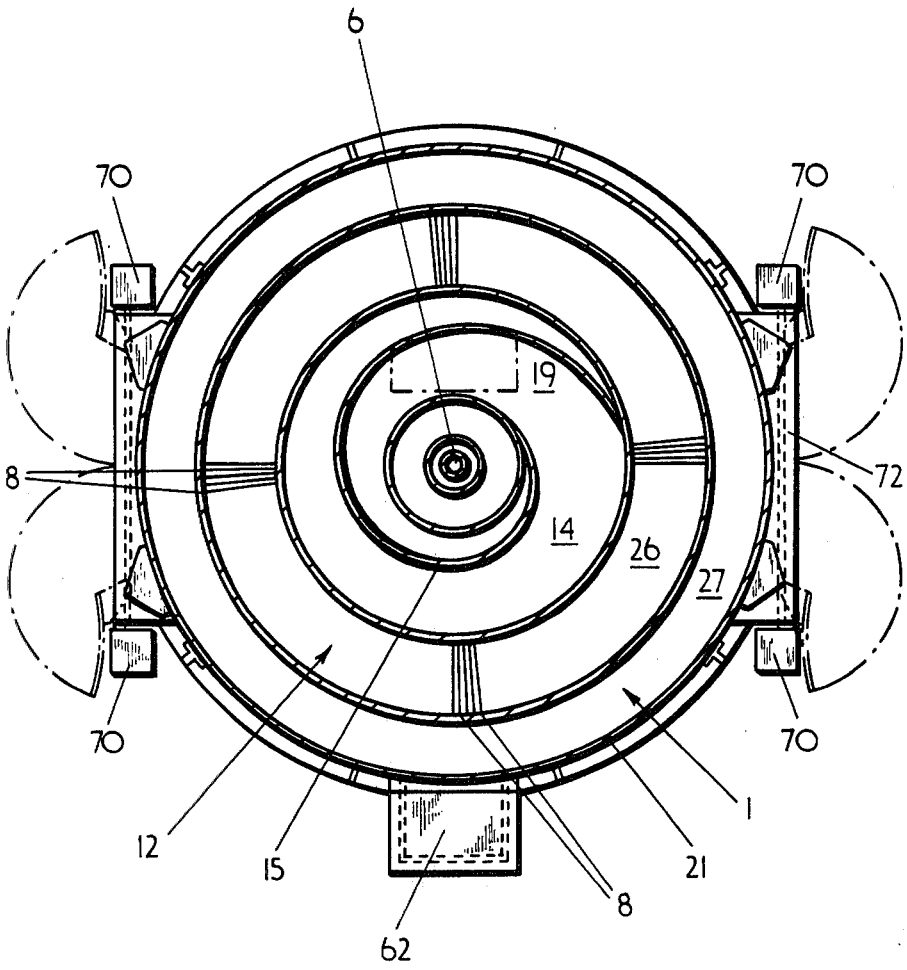
FIG. 4 is a section looking along IV—IV of FIG. 1.

Referring to FIGS. 1, 2, 3 and 4, a sizing screen can be seen to comprise a circular screen surface 1. The screen surface 1 is rotatably mounted and is drivably connected to a motor 3 via a variable speed unit 4 and a flexible coupling 5 and a vertical disposed drive shaft 6 mounted in a fixed reduction gearbox 7. The screen surface comprises a plurality of radially disposed metal rods 8 (see FIG. 4 wherein some of the rods 8 are shown).

Particulate material is fed onto the screen surface by feeder means generally indicated at 12. The feeder means 12 comprises a rotatable feed table 14, a fixed generally spiral plough 15 (see FIG. 4) and a feed chute 16. The rotatable table 14 is drivably connected to a motor 13 via a roller chain linkage 17 and a driven cylinder 18, which cylinder is secured to the table 14. The table 14 rotates about the same vertical axis on the screen surface 1. The outermost boundary of the plough 15 overlaps an innermost boundary thereof to form a compaction zone 19.

A first collection means 20 is positioned around the outer periphery of the screen deck 1. The collection means comprises a cylindrical casing 21 which sleeves the screen deck and the feeder means 12. The casing 21 has a disc shaped top cover plate 22 provided with a hole through which the feed chute 16 feeds particulate material onto the table 14. The sidewalls of the cylindrical casing extend below the screen deck 1.

A second collection means 24 is positioned below the screen deck 1. The second collection means comprises a ring shaped member 25 which partitions or segregates space 26 directly below the deck 1 from the space 27 below but outside of it. In an operation to be described below, oversize material falls into the space 27 and undersize material into the space 26.

Figure 5:
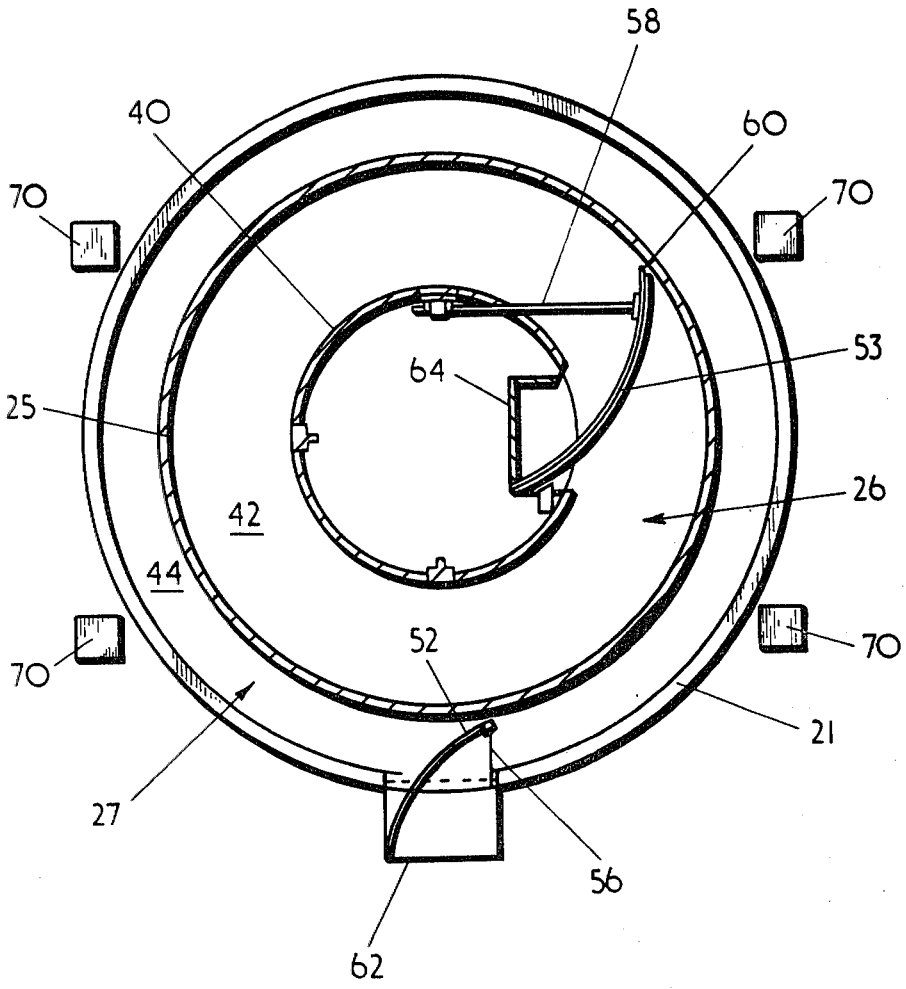
FIG. 5 is a section looking along V—V of FIG. 1.
Figure 6:
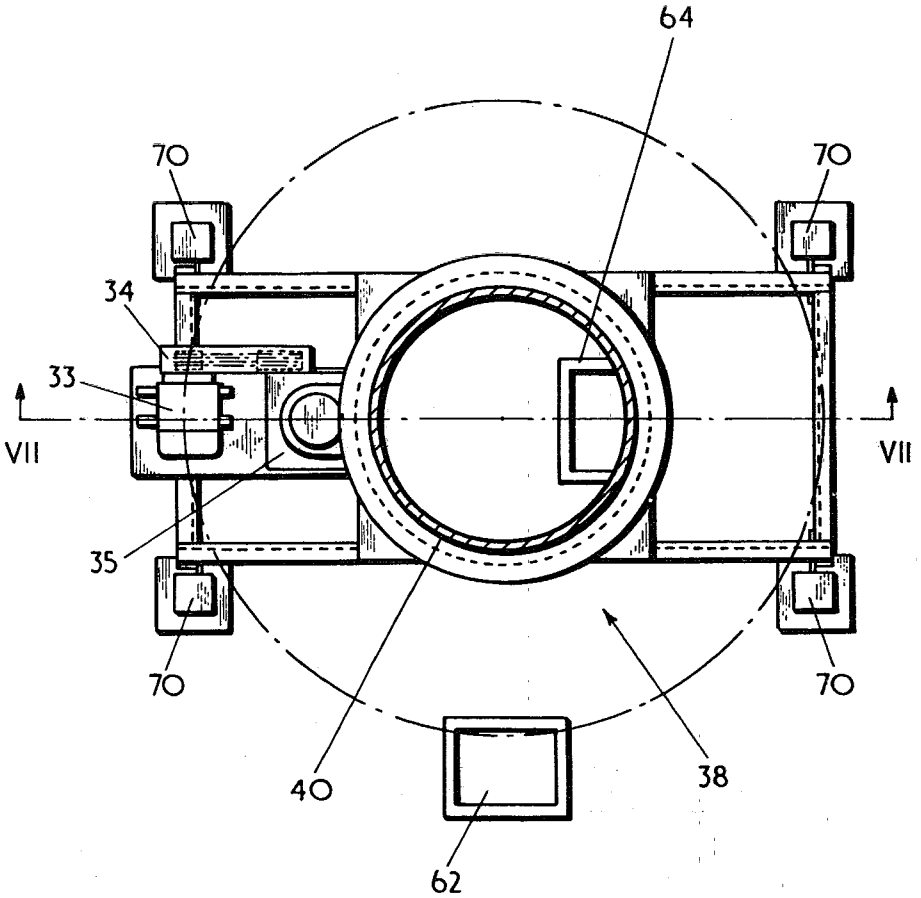
FIG. 6 is a section looking along VI—VI of FIG. 1.
Figure 7:
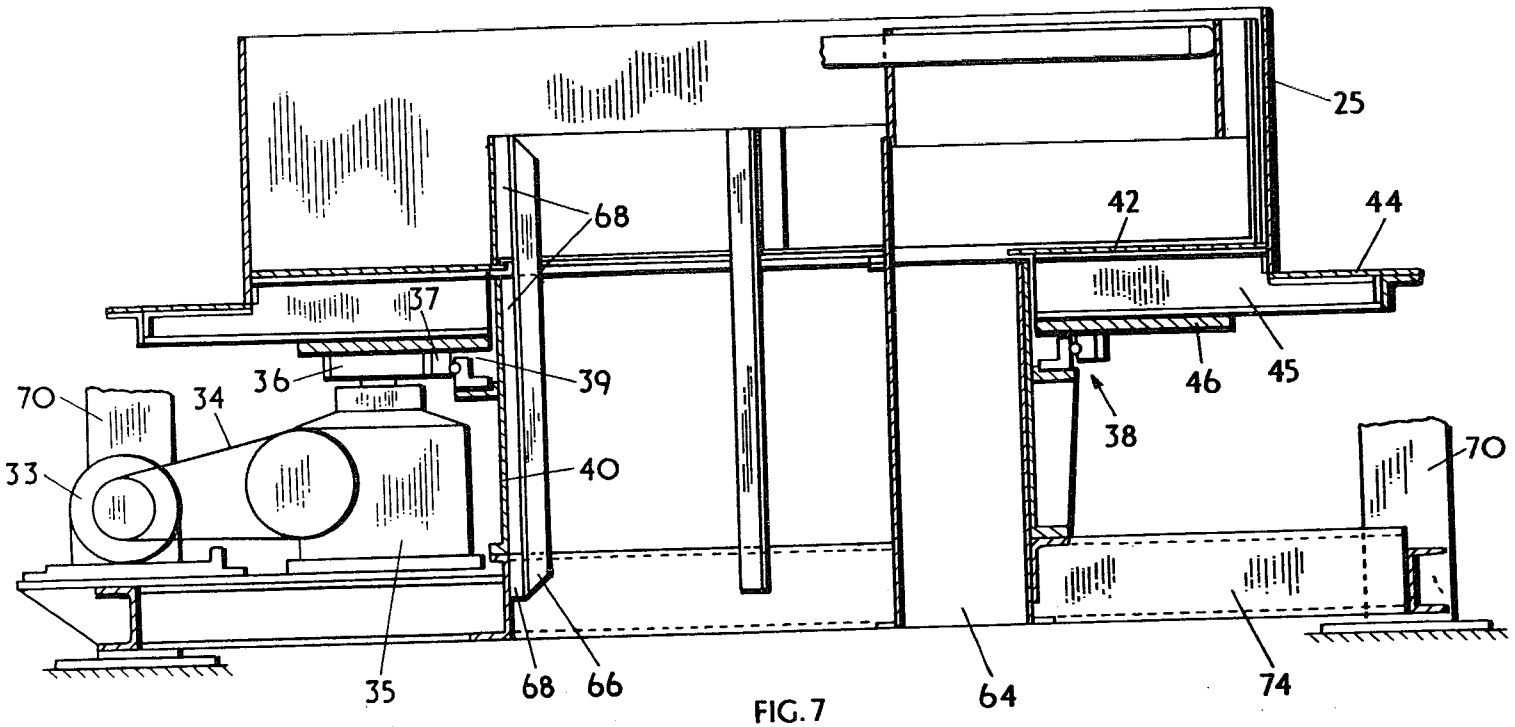
FIG. 7 is a section looking along VII—VII of FIG. 6, also showing extra detail.

A discharge means for the sizing screen is indicated at 30. FIGS. 5, 6 and 7 should now also be referred to. The discharge means 30 comprises a rotatable table 31 driven by a motor 33 via a pulley 34, a gearbox 35 and a pinion 36 which engages on teeth cut on an outer race 37 of a slew ring 38, which outer race is fixedly attached to the table 31. An inner race 39 of the slew ring 38 is fixed to a support cylinder or drum 40. The table 31 is situated under the partition member 25 which is attached thereto and both oversize and undersize material falls onto the table 31. The table 31 is supported via the slew ring 37 on the support cylinder 40, which in turn is supported by a supportive framework to be described below. The partition member 25 keeps the undersize and oversize material on the table segregated. The table 31 comprises a stepped deck plate having parts, 42 and 44. The deck plates are supported by a plurality of stepped radially dispersed support members 45, which themselves are attached to a plate 46 to which the outer race 37 of the slew ring is secured. The partition member is secured to the stepped part of the members 45.

A first outlet means 62 being a discharge chute, is provided for the oversize material, this outlet means being situated outside the member 25. A second outlet means 64, being another discharge chute, is provided for the undersize material. Each of the outlet means 62, 64 has a curved plough associated therewith, the ploughs being indicated by 52 and 53 respectively. The plough 52 is secured at the outlet means 62 by tie rod 56 attached to the cylindrical casing 21. The plough 52 sweeps the entire surface of table 31 between the partition member 25 and the casing 21 during operation to be later described. The plough 53 is secured to the outlet means 64 and is attached to the drum 40 by a further tie rod 58. The plough 53 sweeps the entire surface of table 31 between the drum 40 and partition member 25 during operation to be described below. A renewable blade 60 is provided on the leading edge of the plough 53 which blade extends to the full height of the partition member 25 and prevents the build up of damp undersizes material (fines) on the partition member during operation. A rubber curtain 66 is suspended from the top cover plate to below the deck 1. The flexible rubber curtain inhibits breakage of the oversize materials, reduces noise, and limits build up of damp oversize material by its flexing. The periphery of table 31 extends beyond the cylindrical casing 21 to prevent material escaping over the periphery. The inner part of the table extends into the drum 40 to prevent material escaping into the drum. Clamping member 76 (shown, as angle iron) clamps the upper and lower parts of the drum 40 together. Spacers 68 provide the necessary inset for the table.

Throughout the Figures there is shown a supportive framework for the sizing screen comprising segmented stanchions 70 and support bars 73 and 74. The casing 21 is itself supported by flanges 72 which are supported by the bars 73 on the stanchions 70. The support bars 74 support the discharge means and are themselves again supported on the stanchions. Thus the entire screen is supported by the stanchions 70.

In operation of the invention particulate material such as raw coal containing clay is fed through feeder means 12 onto the screen surface 1. The screen surface can be rotated at a variety of speeds dependent upon the size at which material is to be screened. It will be appreciated that increasing the speed of the screen surface effectively narrows the aperture through which particles of material may fall, i.e. increasing the speed increases the probability that particles will be struck by one or more of the elongate metal rods 8. In this way, the rotation speed defining the effective aperture size, the screen surface 1 selects the size of particles of material which are allowed passage through the screen surface.

Oversize material is urged by centrifugal force towards the outer edge of the screen surface and into the collection means 20. The elongate metal rods 8 do not have support means at their outer radial ends and for this reason no obstruction is offered to the oversize particles in their path towards the collection means. The oversize particles fall through the space 27 onto the table 31. Undersize material passes through the screen surface and through the space 26 onto the table 31.

The discharge table 31 (as shown in FIG. 5) rotates in a clockwise direction and carries the material thereon to the ploughs 52 or 53 for oversize or undersize material as the case may be. The ploughs 52 and 53 are fixed by the support rods 56 and 58 so that material cannot deflect them. The ploughs provide a positive feed into the respective outlet means as there is no part of the table surface which they do not sweep in operation (see FIG. 5). Consequently, the material is urged by the ploughs onto the respective discharge means, i.e. the oversize material is urged by the plough 52 into the outlet means 62 and the undersize material into the outlet means 64. Thus there is provided a discharge means which does not permit clogging build up of material therein. The slew ring 38 is self centring and absorbs side thrusts exerted on the table 31 by the ploughs during operation.

Figure 8:
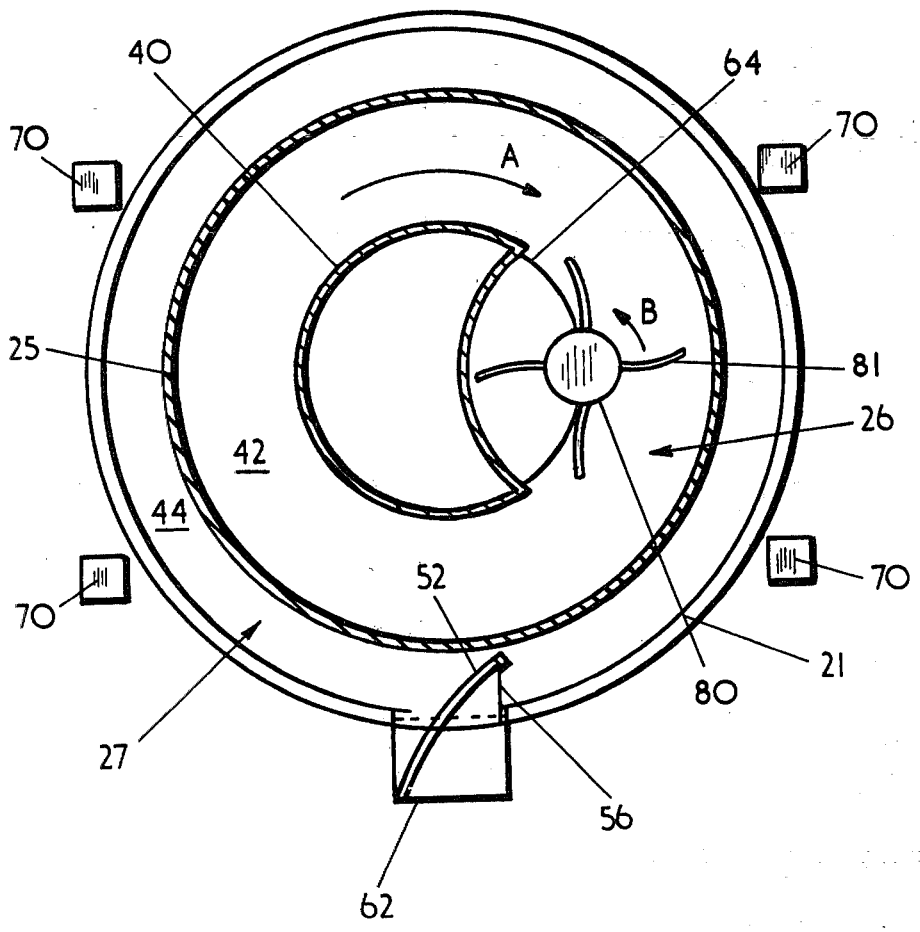
FIG. 8 is a section analogous to FIG. 5, illustrating an alternative arrangement of urging means.

Referring now to FIG. 8, in place of the fixed plough 53, a drivable paddle arrangement is used. The same identifying numerals are used for the same or analogous parts. A hub 80 carries four curved paddle members 81 which extend across the part of the table which carries the undersize fraction of material. The hub rotates in the direction indicated by arrow B, contrary to the direction of rotation of the table, indicated by arrow A, and the paddle members sweep material from the table into the mouth of the discharge chute 64. The hub is driven by a shaft (not shown) extending downwardly which in turn is driven by a motor (not shown) mounted on the framework of the apparatus.

From the above description, it can be seen that the present invention provides an improved sizing screen and discharge means therefor.

We claim:

1. A sizing screen apparatus for particulate material of different sizes comprising:

a generally horizontal rotatable circular screen surface having a plurality of elongate radially projecting members free of support means at their outer radial ends and a first driving means connected thereto, a feeder means for feeding particulate material onto the screen surface, a first collection means positioned adjacent to and radially outward of the outer periphery of the surface for receiving and conveying an oversize fraction of the particulate material, second collection means positioned below the surface for receiving and conveying an undersize fraction of the particulate material which passes through the screen;

a rotatable table positioned below the first and second collection means, means partitioning said table into different parts for receiving and carrying the oversize and undersize material respectively from said collection means discharge outlet means below said rotatable table for said oversize fraction and said undersize fraction, urging means at fixed positions in relation to said rotatable table and adjacent said oversize and undersize outlet means for directing the fractions into their respective outlet means and a second driving means for said rotatable table separate from said first screen driving means so that said table is rotatable at a speed different from that of the screen.

2. A sizing screen apparatus as claimed in claim 1, wherein the urging means is a plough.

3. A sizing screen apparatus as claimed in claim 1, wherein the urging means is a drivable paddle.

4. The apparatus of claim 1, including a rotatable feed table positioned above said screen surface for uniform distribution of particulate material and a driving means for said feed table separate from the driving means for said screen.

* * * * *